United States Patent [19]

Luyk et al.

[11] Patent Number: 4,783,121

[45] Date of Patent: Nov. 8, 1988

[54] IMPROVED CHAIR WITH CONVEX UPPER BACKREST AND FORWARD SEAT SURFACES

[76] Inventors: Harley E. Luyk, 4808 Summergreen La., Hudsonville, Mich. 49426; Dewey D. Blocksma, 40 E. 27th St., Holland, Mich. 49423

[21] Appl. No.: 48,084

[22] Filed: May 11, 1987

[51] Int. Cl.[4] ..... A47C 3/00

[52] U.S. Cl. ..... 297/300; 297/304; 297/361; 297/459

[58] Field of Search ..... 297/459, 457, 300, 304, 297/320, 322, DIG.2

[56] References Cited

U.S. PATENT DOCUMENTS

| | | | |
|---|---|---|---|
| 1,567,696 | 12/1925 | Angell | 297/459 |
| 1,917,264 | 7/1933 | Kellogg | 297/459 |
| 1,938,879 | 12/1933 | Waggoner et al. | 297/459 |
| 2,745,468 | 5/1956 | Kramer | 297/285 |
| 3,740,096 | 6/1973 | Bridger | 297/459 |
| 3,740,792 | 6/1973 | Werner | 297/300 |
| 4,005,903 | 2/1977 | Jenni | 297/361 |
| 4,008,367 | 5/1978 | Atkinson et al. | 297/457 |
| 4,295,626 | 10/1981 | Large | 297/304 |
| 4,380,352 | 4/1983 | Diffrient | 297/312 |
| 4,650,248 | 3/1987 | Borsani | 297/300 |
| 4,671,570 | 6/1987 | Hockenberry et al. | 297/459 |

FOREIGN PATENT DOCUMENTS

| | | | |
|---|---|---|---|
| 72003 | 5/1943 | Czechoslovakia | 297/459 |

OTHER PUBLICATIONS

H. Dreyfuss, Whitney Library of Design 2nd Ed., (1959).

H. Dreyfuss, Architectural Graphic Standards, Am. Institute of Architects, Ramsey/Sleeper 7th Ed., (1981).

Grandjean et al., Ergonomics, vol. 12, No. 2, 307-315, (1969).

*Primary Examiner*—Francis K. Zugel

*Attorney, Agent, or Firm*—Ian C. McLeod

[57] ABSTRACT

An improved chair (10) having convex back rest portions (11*a*) and a convex seat front portion (13) is described. The seat is designed to externally rotate the hip joints ($P_7$ and $P_8$) of a seated person P towards the floor or other support surface. The convex back rest portions and seat rest portions preferably include flexible segments (A and E) for increased support. The chair provides greater comfort and body support.

20 Claims, 9 Drawing Sheets

IMPROVED CHAIR WITH CONVEX UPPER BACKREST AND FORWARD SEAT SURFACES

SUMMARY OF THE INVENTION

1. Background of the Invention

The present invention relates to an improved chair which provides enhanced comfort and support because of convex surfaces on a seat and back rest supporting the back and legs of a seated person. In particular the present invention relates to an improved chair with a forward portion on the seat which externally rotates the hip joints towards a support surface for the chair by means of one convex surface supporting the upper legs and with the back rest providing support for the back of the person by means of a second convex surface on the upper portion of the back rest.

2. Prior Art

Since the early 1970's, ergonomic theory has dominated chair design, selecting as the focal point, the juncture of the sacral and lumbar vertebrae (L5, S1). This is the zone where symptoms of muscle strain and bone degeneration from a chair often first appear. Ergonomic thinking has developed a variety of ways to support this area while attempting to facilitate body movement. Facilitating body movement has been one of the primary goals of chair design of the last decade. This goal has only been partially realized.

Although the shapes of chairs have changed dramatically over the last several years, a comparison of current anthropormorphic data to that suggested by Dreyfuss (Henry Dreyfuss, Whitney Library of Design 2nd Ed., (1959) and Henry Dreyfuss, Architectural Graphic Standards, Am. Institute of Architects, Ramsey/-Sleeper 7th Ed., (1981)) shows little change in the recommended seating position. Current design thinking still advocates a legs out in front with knees together position, and a leg to back angle of about 90 degrees as shown in FIG. 2 as the ideal working posture. However, Anderson's classic work in 1974 (B. Anderson et al, Scand. J. Rehab. Med. 6: 104–114, (1974) and B Andersson et al, Scand. J. Rehab. Med. 6: 115–121, (1974)) shows that high disc pressures exist in this position.

Why do the majority of designers still recommend this seating position? The reasons are to be found in the assumptions about seating which have been unconsciously incorporated into the research apparatus and thought stances responsible for current data, and a misunderstanding of anatomy, especially the pelvic anatomy.

Some current assumptions are:

(1) That only two views of the human being, the front view and the side view, are adequate to describe correct posture. These views however, ignore or simplify rotational movements. The Grandjeans (E. Grandjean et al, Ergonomics, Vol. 12, No. 2, 307–315, (1969)) "seating machine" also operates mainly in two planes and as a result, rotational movements cannot be tested.

(2) That joints can be represented by single points. The way that the hip joint is pinned at a single point in automobile testing mannequins, is an example (cite). Automotive CAD system programs also simplify the hip joint.

(3) That the human anatomy needs to be supported into a fixed position. Of course fixed references are needed for any movement, but support need not develop into "splinting" which means the legs and feet are locked into the position shown in FIG. 2.

(4) That ergonomic thinking means flexibility, yet in conventional chair design the concave shape of the back splints the lung, decreasing respiration while the concave shape of the seat splints the legs, thereby limiting abduction, external rotation, and weight transfer to the floor through the femur.

Current anthropomorphic data suggests the notion of how people should sit, but how do people actually sit? Libraries are a good place to look because the norms of the home or office are not required there. A number of curious configurations are found, and each can be seen as an inventive way to transfer the weight of the body to the ground. Weight can be transferred through the chair and through the arms via a table or desk and through the legs, thus there are a variety of forms of force transfer that can be used. People do in fact use their legs to drain off torso weight so all of it does not have to go through the lower back and chair seat. They tuck a foot behind a chair leg or drop one knee over the edge of the chair or sit on the edge of the chair with knees bent and back straight to move their center of gravity over their ankles. We do not have a massive tail like the dinosaur or kangaroo for ballast so we have to transfer weight through the lower back using some other form of stabilization which the pelvis should provide.

Examples of pelvic stabilization are seen at the local health club or dance studio. Weight lifters long ago realized the best posture for lifting. They externally rotate each foot about 30 degrees which externally rotates the legs, stabilizes the pelvis and keeps their back straight, thus allowing large weights to be lifted without injury. Sitting is also a weight lifting activity and pelvic stability is the key to avoiding injury. A dancer could reach only a fraction of the positions required by classical ballet without external rotation of the hip joint, creating pelvic stabilization.

To understand external rotation, an understanding of the anatomy of the pelvis and the femur, especially the angle at which the femoral neck of the femur meets the rest of the femur, the length of the neck of the femur, and the role of the trochanter in mechanical purchase. The trochanter is the place of attachment of a large number of muscles originating on the pelvis (Anatomy for Surgeons, Vol 3, Hoeber-Harper, pp. 641–692, (1958)). Included among these are the Gluteus Maximus, and more specifically the Gluteus Medius and Minimus, the Tensor Faciae Latae, the Piriformis, the Obturator Internus, the Gemellus Superior, and Inferior the Quadratus Femoris, and the Obturator Externus (Anatomy for Surgeons, Vol. 3, Hoeber-Harper, pp. 641–692, (1958)). FIG. 1 shows external rotation of the leg femur ($P_7$ and $P_8$) of a seated person P.

In the Dreyfuss seating position previously described and as shown in FIG. 2, many of the pelvic muscles are unable to stabilize the pelvis because they are in the extended position. Asking these muscles to lift a weight in the extended position is almost impossible. In the middle third of their range, they perform best. Try rising from a chair with the knees together and it can be seen how difficult pelvic stabilization is in this position.

Besides reducing the effort required to rise from a chair, there are other advantages to external rotation, such as a change in the angle between the leg and back. Interestingly, external rotation automatically increases that angle by ten to fifteen degrees to a more oblique angle. Another advantage is the even distribution of seat pressure. When there is external rotation, the trochanters on the sides of the buttocks become new centers for force transfer, taking some of the pressure off the ischial tuberosities. In the externally rotated position, the gluteal muscles are only partially flexed and provide a better pad over the ischial tuberosities and the coccyx. There are now five areas of force transfer rather than two on the hip bones. Seat prints using individual air cells on a flexible membrane demonstrate the wider distribution achieved with external rotation of the hip joint.

External rotation is often unknowingly used to stabilize the pelvis. An example would be crossing the legs which externally rotates the thigh and uses the weight of the calf to put upward pressure on the hip joint of the crossed leg. This happens in a more extreme way when we put one foot on the opposite knee. But crossing the legs puts pressure on the back of the knee which impedes venous return. Crossing the legs also doubles up on the weight transferred through the opposite leg and can only be tolerated for short lengths of time as is well known.

The ideal chair should: (1) Give paraspinal support but not impede lung inflation; (2) Allow external rotation of the hip, making pelvic stabilization possible; (3) Allow the center of gravity of the seated person to shift closer to the ankles, decreasing the work of sitting and rising; (4) Distribute the persons weight evenly over the entire seat area; (5) Decrease body weight transferred through the middle of the seat by using the femur to transfer weight; (6) Provide support without splinting the legs and back into a fixed position.

OBJECTS

It is therefore an object of the present invention to provide an improved chair which overcomes the problems of the prior art caused by the concave chairs by providing the chair with convex surfaces which externally rotate the hip joint and which allow free rotation of the upper torso while supporting the back of a seated person. Further it is an object of the present invention to reduce disc pressure, evenly distribute seat pressures over the buttocks and thighs, increase spinal support and improve lung function using the improved chair. Further it is an object of the present invention to provide an improved chair which is relatively simple and economical to construct. These and other objects will become increasingly apparent by reference to the following description and the drawings.

IN THE DRAWING

FIG. 1 is a perspective view schematically showing an improved chair 10 of the present invention with a seated person P wherein the forward seat 13 and back rest 11*a* are convex in cross-section and wherein the hip joint is externally by the chair 10.

FIG. 2 is a perspective view schematically showing a conventional prior art chair 20 including a seated person P wherein the seat 22 and back rest 21 are concave thus providing the disadvantages of the prior art claims.

FIG. 3 is a side view of a preferred chair 30 of the present invention with a back rest 31 and seat 33 which have a convex cross-section.

Figure 8:
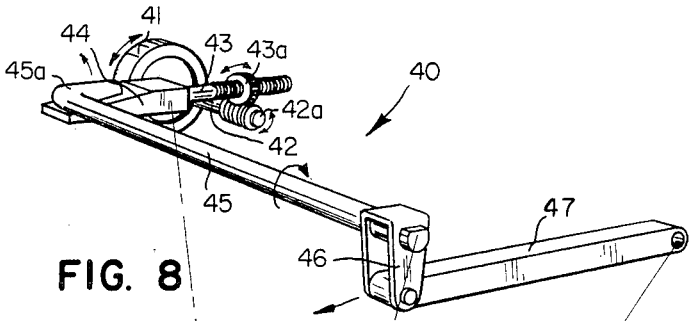

FIG. 8 is a perspective view showing the back rest 31 tensioning torsion bar mechanism 40 for the chair 30.

Figure 9:
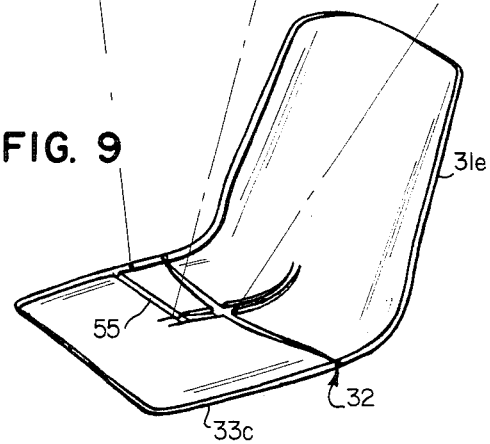

FIG. 9 is a perspective view of the forward seat structural shell 33*c* and back rest structural shell 31*e* in outline form combined with FIG. 8 to show the mounting of the bar mechanism 40.

Figure 10:
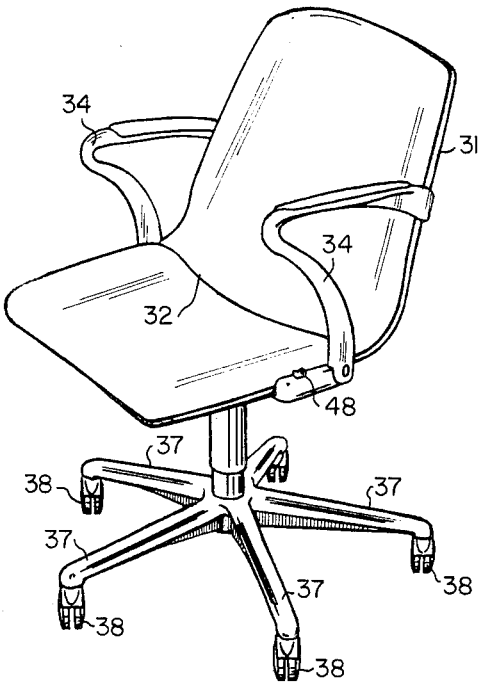

FIG. 10 is a perspective view of the assembled chair particularly sho the seat height adjusting button 48.

Figure 11:
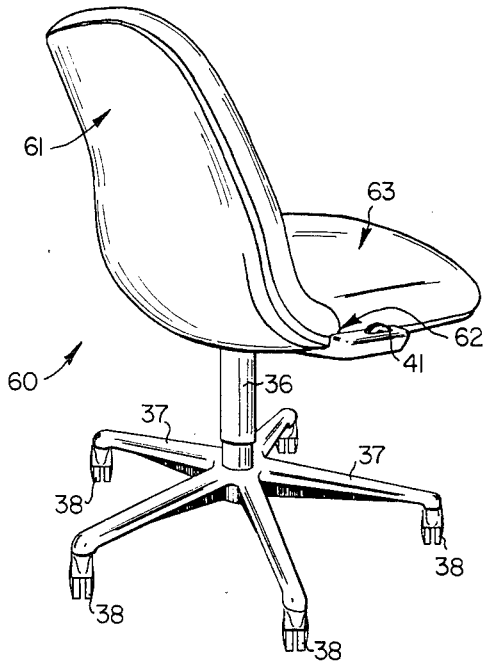

FIG. 11 is a perspective view of another preferred chair 60 without arms.

Figure 12:
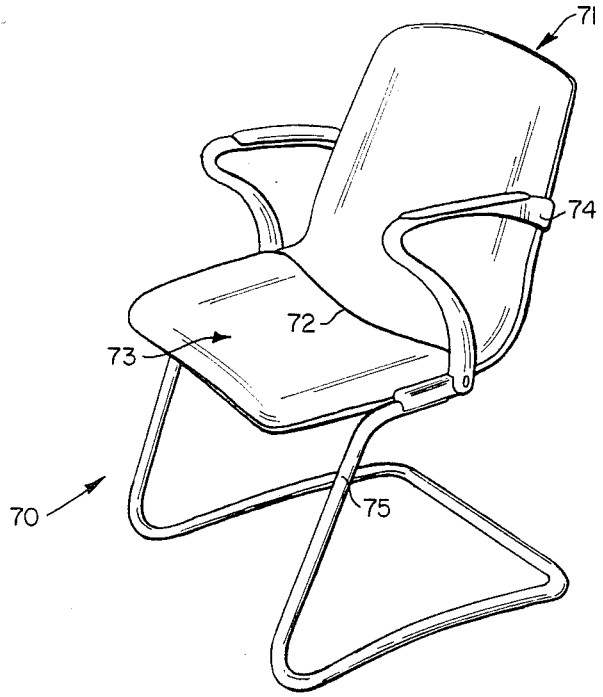

FIG. 12 is a perspective view of still another preferred chair 70 with sled type tubular legs 75.

Figure 5:
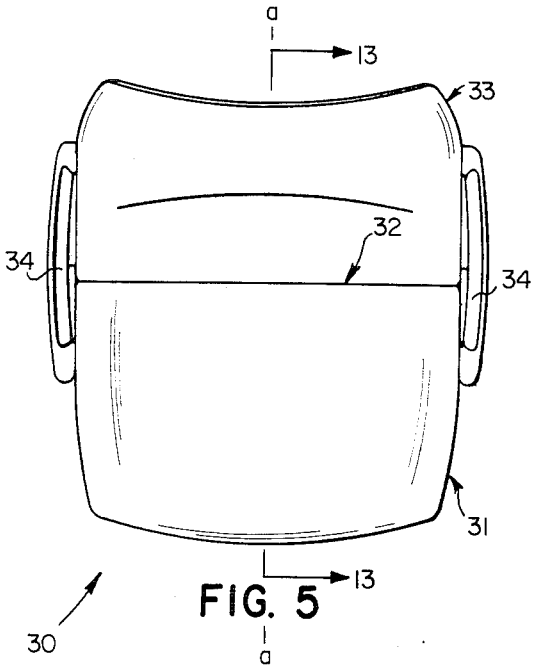
FIG. 5 is a plan view of the chair 30 shown in FIG. 3.
Figure 13:
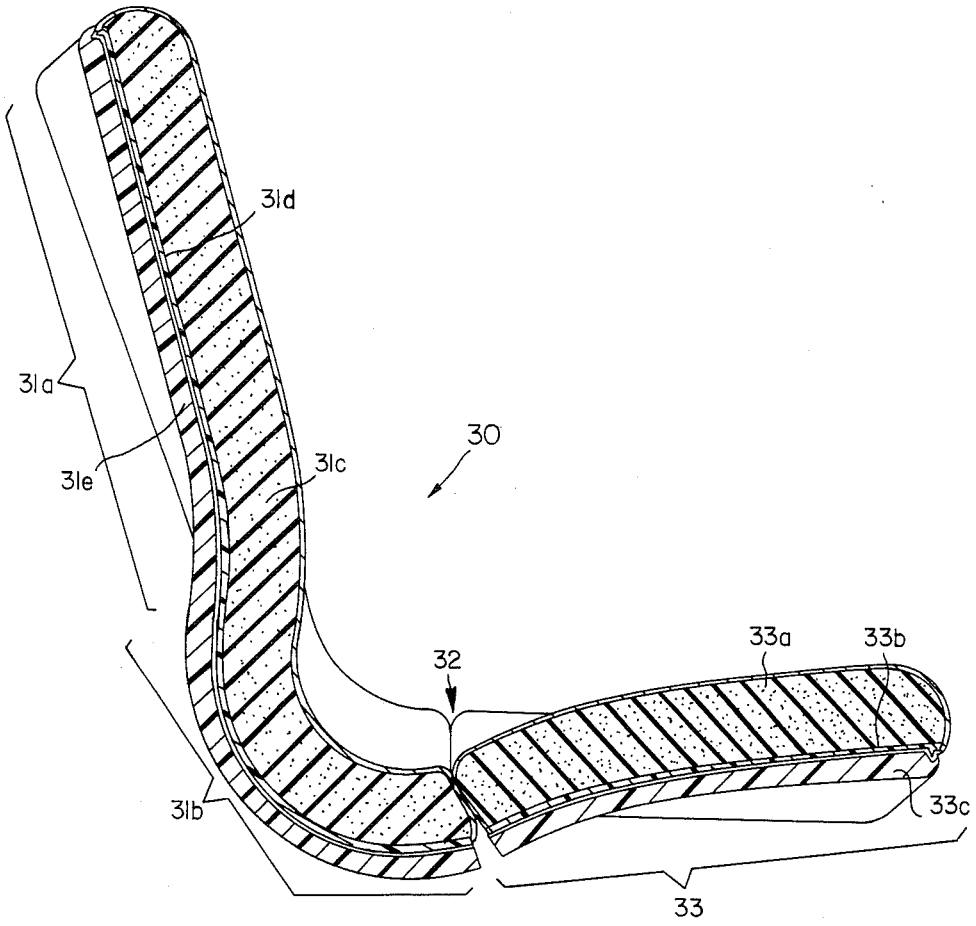

FIG. 13 is a side cross-sectional view of the chair along line 13—13 of FIG. 5 showing the cushion 31*c*, upholstery shell 31*d* and back rest structural shell 31*e* for the back rest 31 as well as the cushion 33*a*, upholstery shell 33*b* and forward seat structural shell 33*c* for the chair 30.

Figure 14:
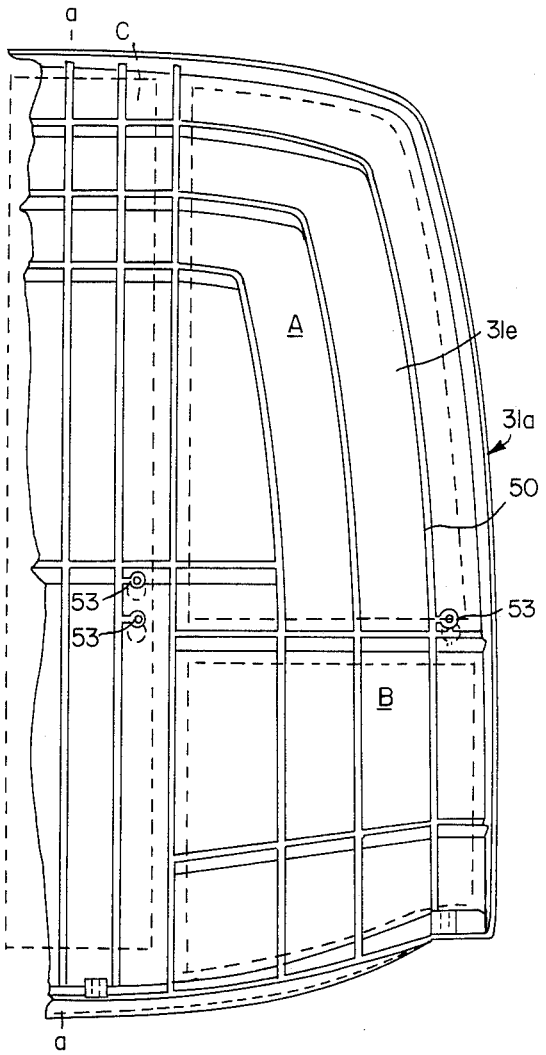

FIG. 14 is a front view of the back rest 31 shown in FIG. 13 in half partial section along the midline a—a showing segments A, B and C which allow for variable flexing of the upper lateral segments A of the back rest 31.

Figure 15:
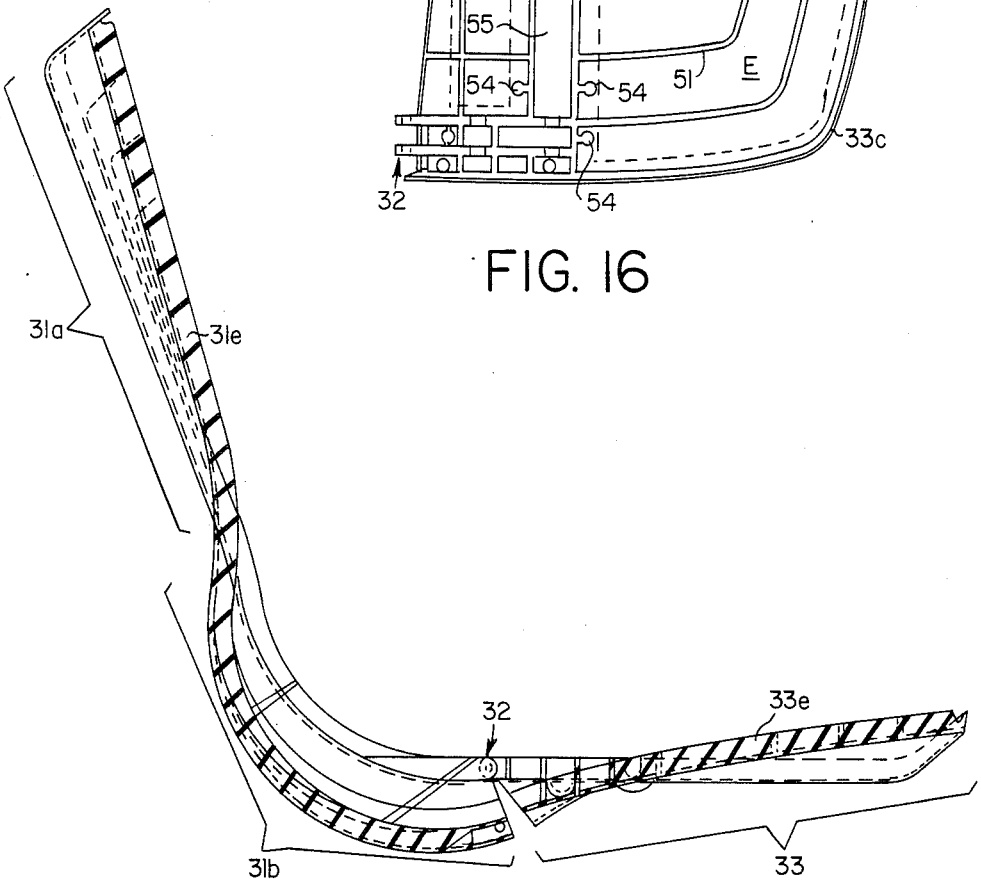

FIG. 15 is a side cross-sectional view of the back rest 31 and forward portion of the seat 33 joined together at pivot 32.

Figure 16:
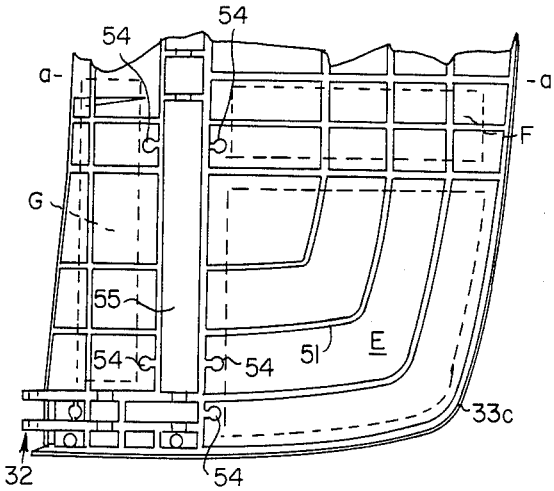

FIG. 16 is a plan view in half partial section along the midline a—a of the forward structural member 33*c* showing one of two segments E on the lateral forward portions of the member 33*c* which are relatively more flexible.

Figure 17:
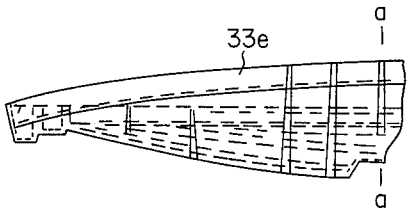

FIG. 17 is a front view in partial section along the midline a—a of the forward section of the front seat structural shell 33*e* showing the convexity of the seat 33.

Figure 18:
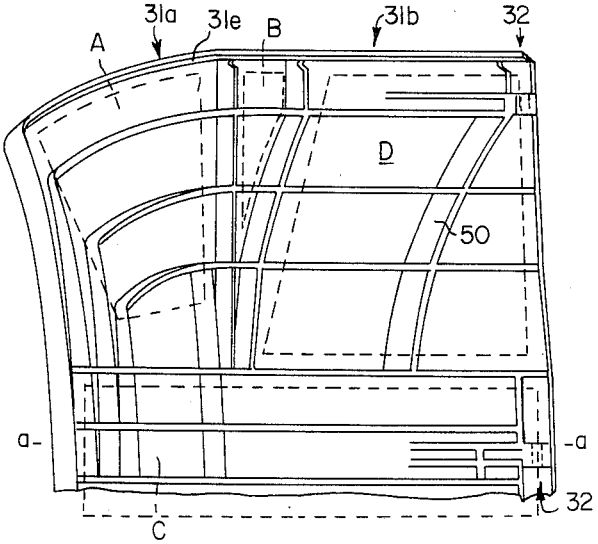

FIG. 18 is a plan view in partial section along the midline a—a of the back rest 31 structural shell 31*e* shown in FIG. 14 particularly showing the concave segments D for the buttocks of the person P and the convex segment A.

GENERAL DESCRIPTION

The present invention relates to the improvement in a chair including a seat means for supporting the buttocks and upper legs of a seated person and a back rest means extending from the seat means for supporting the back of the person and a support means for the seat means which comprises: a seat means wherein an upwardly facing surface supporting the upper legs of the person is convex in vertical cross-section on opposite sides of a vertical midline of the chair such that the hip joints in the buttocks of the person externally rotate downward causing the knees to tend to spread apart and the feet of the person to point outwardly; and a back rest means extending from a union with the seat means with a forwardly facing surface supporting the back of the person which is convex in horizontal cross-section on opposite sides of the vertical midline of the chair.

The present invention specifically relates to the improvement in a chair including a seat means for supporting the buttocks and upper legs of the person and a back rest means extending from the seat means for supporting the back of the person and a support means for the seat means which comprises:

(a) a seat means wherein an upwardly facing surface supporting the upper legs is convex in vertical cross-section on opposite sides of a vertical midline of the chair such that the hip joints in the buttocks of the person externally rotate downward causing the knees to tend to spread apart and the feet of the person to point outwardly; and (b) a back rest means extending from a union with the seat means with a forwardly facing surface supporting the back of the person which is convex in horizontal cross-section on opposite sides of the vertical midline of the chair, wherein the union has a curved surface between the seat means and the back means supporting the buttocks which is concave in cross-section on opposite sides of the vertical midline of the chair.

The term "chair" includes any sort of a seat for a person. Included for instance is an automotive seat.

Preferably the chair of the present invention has a horizontal pivot between the seat means and the back rest means (FIGS. 3 to 18). Also preferably adjacent lateral forward segments of the seat means are flexible so that the weight of the upper legs of the person bends the lateral forward segments to provide increased convexity of the seat means and wherein a front central segment of the seat means between the lateral forward segments is relatively more rigid. A rear portion of the seat means supporting the upper legs, the union covered by the buttocks and a lower portion of the back rest means in the lumbar region of the person are rigid. Lateral upper segments of the back rest means are relatively less rigid than the rear portion of the seat means, union and lower portion of the back rest means such that the shoulders can bend the upper lateral segments to provide increased convexity as increasing pressure from rotation of the back is applied.

The convex chair is preferably constructed (as shown in FIGS. 13 to 18) using outer structural shells of an injection molded, glass reinforced thermoplastic resin and inner two-piece upholstery support shells of injection molded polypropylene (or a similar material) that connect to form a laminate with separate segments varying in contour and flexibility. The flexible segments provide increased convexity when weight or pressure of the person is applied.

A semi-rigid segment extends up the central area of the upper portion of the back rest to give paraspinal support and is combined with the moderately flexible segments, extending downward and inward from the uppermost outside corners of the back rest which is convex in horizontal cross-section to allow expansion of the lungs and free rotation of the upper torso on a vertical axis defined by the midline a—a of the chair. A more rigid lower portion of the back rest, which preferably extends downward and curves rearward to provide lumbar support, then curves forward to form the rear portion of the seat, which is concave in vertical section and provides the ischial tuberosities and trochanters with a position of anchorage for the pelvic stabilization necessary to support the lower back.

Another rigid segment of the front portion of the seat preferably extends forward from the pivot with the back rest and provides an anchorage for a tilt control mechanism. A section of the front portion of the seat which is less rigid, extends through the central area of the front portion of the seat and is combined with the lateral flexible segments extending inward and rearward from the forward most outside corners of the seat to facilitate external rotation of the hips and allow movement of the lateral segments to provide lower overall seat pressures and more uniform weight distribution over the entire seat area.

The juncture of the forward portion of the seat and the back rest forms the horizontal pivot beneath and forward of the hip joint. This pivot permits the rear portion of the seat and the back rest to move rearwardly independently of the forward portion of the seat so that when tilting, the feet remain firmly on the floor with no increase in pressure on the underside of the knee and the shear forces between the back and the back rest are minimized.

Preferably a yoke assembly, fastened to the edge of the forward portion of the seat at each side and aligned with the juncture of the back rest, provides an anchorage for a spindle or pedestal between the chair and a base assembly to permit rotational movement of the chair about a vertical axis. Various conventional support means for the seat can be used.

Arm rests on the chair are preferably positioned rearward at either end of the yoke so as not to inhibit external rotation. The arm rests extend upward while curving forward then curve upward and rearward to a point of attachment to the back rest. The inside edge of the horizontal portion of this assembly which forms the arm rest is preferably slanted downward and inward to accommodate the natural angle of the forearm in a resting position. Attached to the yoke with a pivot pin adjacent to the juncture of the forward portion of the seat and the back rest and to the back rest the entire arm assembly moves with the movement of the back rest when the chair tilt is tilted.

To accommodate users of differing size and weight, two adjustments are provided. The first, tilt tension, is preferably provided via a spring torsion bar mechanism (FIGS. 7 and 8) integrated into the forward portion of the seat. This device, which includes a torsion bar, is actuated by linkage connected to the center forward edge of the lower portion of the back rest. Adjustment is accomplished through a worm and gear assembly driven by a thumb activated wheel located at the upper outside edge of the seat just forward of the arm support. The second adjustment is for seat height and is provided by a gas spring located in the spindle between the chair and the base. Adjustment is preferably accomplished by depressing a button located at the seat edge opposite the back tension adjustment wheel.

The chair is preferably supported by a base having five legs radiating outward from a central hub with glides or castered wheels at the end of each leg (FIGS. 3 to 11) or by a sled base (FIG. 12) constructed of tubular steel attached to the yoke assembly below the arm supports which extends downward and forward to a point of vertical alignment with the front edge of the seat then curves rearward along the floor to a point of vertical alignment with the top edge of the back rest then curves along the floor toward the center of the chair and continues to the opposite side of the chair.

SPECIFIC DESCRIPTION

In the following description the lines a—a define the midline between the right and left sides of the chair relative to the seated person P.

Figure 1:
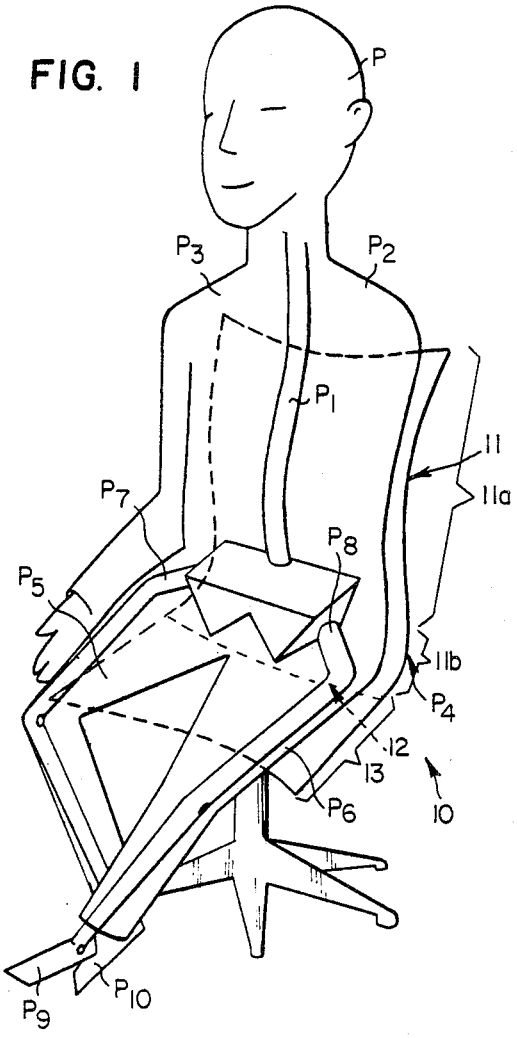
Figure 2:
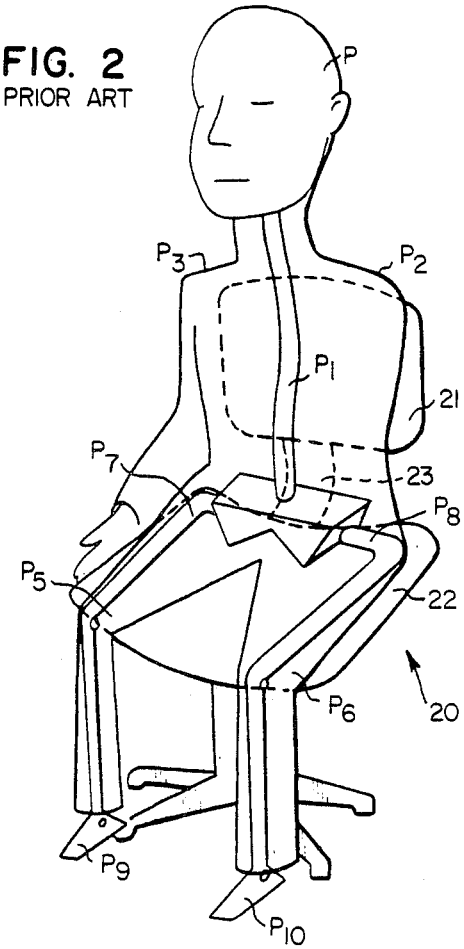
FIG. 2 PRIOR ART
Figure 3:
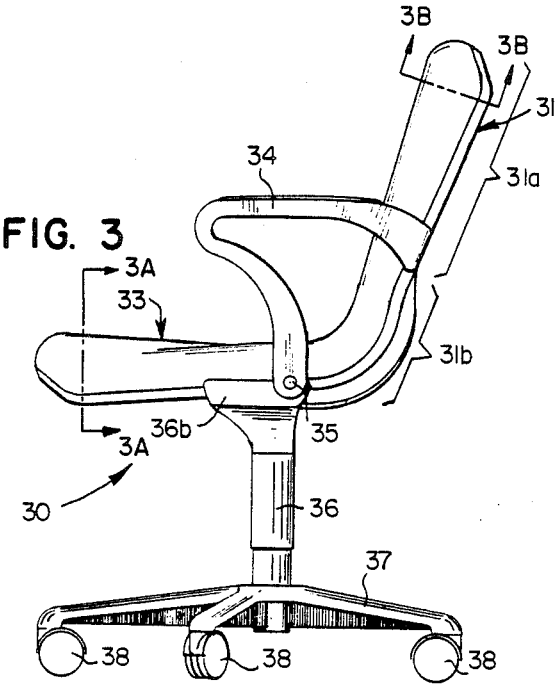
Figure 3B:
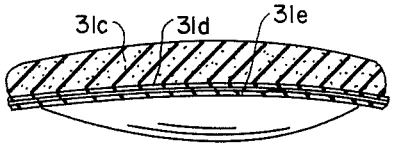
Figure 3A:
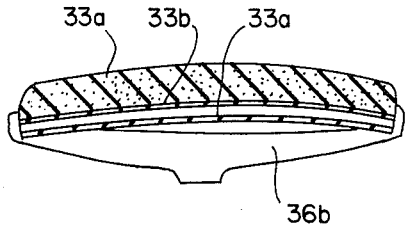
Figure 4:
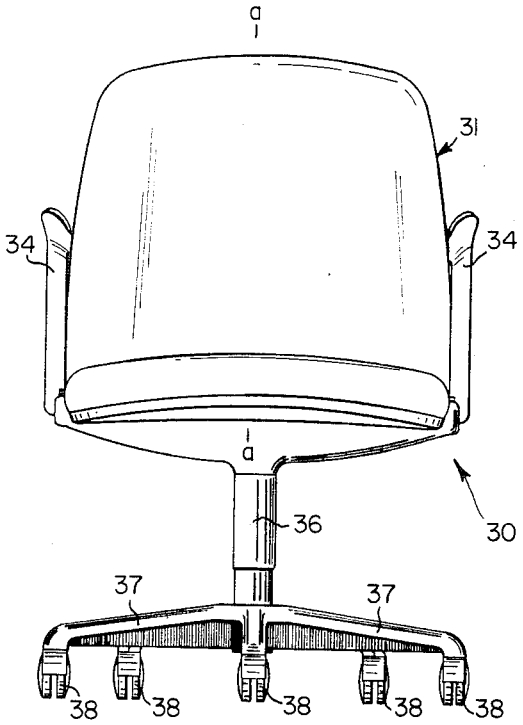
FIG. 4 is a front view of the chair 30 shown in FIG. 3.

FIG. 1 schematically shows the construction of the chair 10 of the present invention including a back rest 11, back rest upper portion **11*a* integrally formed with a seat rear portion 11b supporting the rear of the buttocks and lower back $P_4$ of the seated person P. The back rest portion 11a is convex in horizontal cross-section perpendicular to the midline a—a so that the backbone $P_1$ is in contact with the back rest upper portion 11a and the shoulders $P_2$ and $P_3$ are urged into a concave position corresponding to the convex horizontal cross-section of the back rest upper portion 11a. The seat rear portion 11b is concave in vertical cross-section perpendicular to the midline a—a to adapt to the buttocks $P_4$ of the person P. A pivot 12 mounts the back rest 11 to a seat front portion 13 which also has a convex vertical cross-section perpendicular to the midline a—a. The legs $P_5$ and $P_6$ of the person P are spread apart by the chair 10 such that the upper hip joints $P_7$ and $P_8$ rotate towards the floor, thus causing the feet $P_9$ and $P_{10}$ to tend to cross. The result is a much more comfortable chair 10 where the person assumes a more natural posture than is achieved with the prior art chair 20 as shown in FIG. 2. In prior art chair of FIG. 2, both the back rest 21 and the seat 22 are concave in horizontal and vertical cross-section respectively, and are joined by a rigidly flexible member 23. As can be seen from FIG. 2, the hip joints $P_7$ and $P_8$ tend to be rotated away from the floor and the legs $P_5$ and $P_6$ and feet $P_9$ and $P_{10}$ tend to be parallel to each other when viewed in a horizontal or vertical plane. The chair 20 is the conventional type of office chair which is used in business today. Based upon tests of weight distribution over the surface of the seat and back, the prior art chair 20 tends to concentrate the weight in the center of the seat and does not adequately support the back. The improved chair 10** provides much greater user comfort over an extended period of time.

FIGS. 3 to 10 show a preferred chair 30 according to the present invention. The chair 30 includes a back rest 31 with an back rest upper portion 31a and a seat rear portion 31b. A pivot 32 (FIGS. 5, 7, 9 and 10) joins the back rest 31 to a seat front portion 33. Both the back rest upper portion 31 and front seat portion 33 are convex in cross-section. The seat rear portion 31b is concave. The chair 30 includes an arm 34 having an irregular curved shape fixed at one end to the back rest 31 and pivoted at pivot 32 by pin 35. The chair 30 includes a conventional base 36 with arms 37 supporting wheels 38. A conventional gas spring 36a is provided to adjust the height of the chair. A yoke 36b is part of the base 36 and supports the seat front portion 33.

Figure 7:
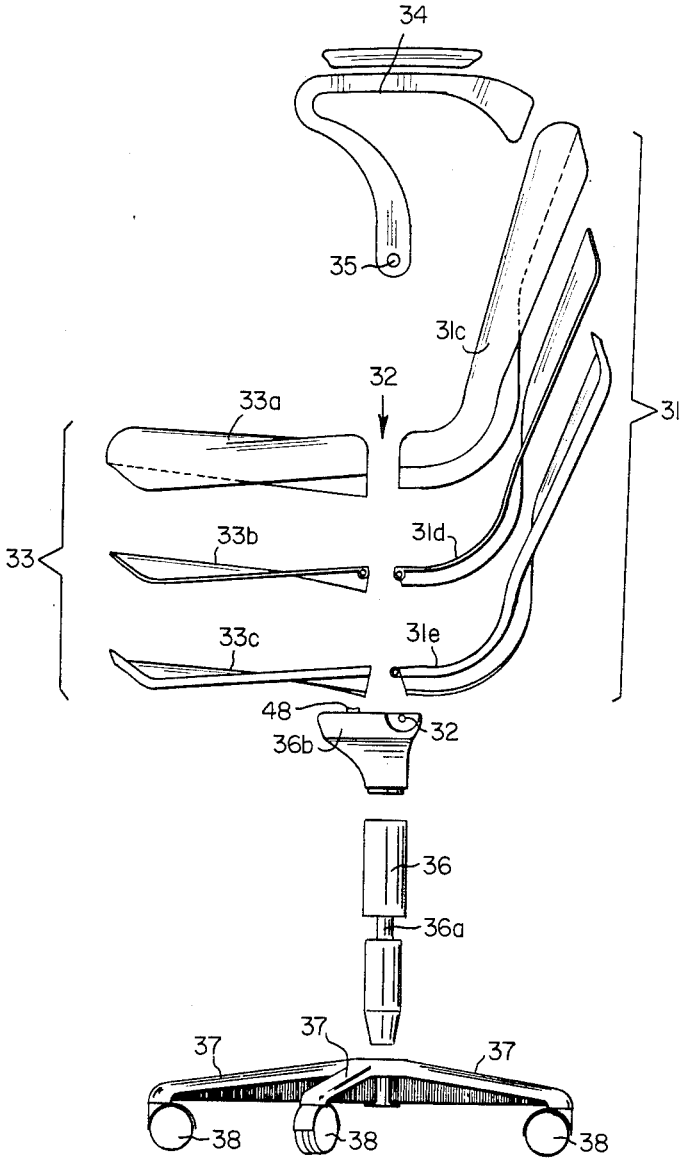
FIG. 7 is a side separated view of the chair 30 showing the components forming the chair 30.

FIGS. 7 and 13 show the details of the construction of the major components of the chair 30. This includes molded back and forward seat cushions 31c and 33a respectively, molded back and forward upholstery support shells 31d and 33b, respectively, and molded back and forward seat structural shells 31e and 33c, respectively. As can be seen the back upper portion 31a and seat forward portion 33 are convex in cross-section and the seat rear portion 31b is concave in cross-section.

FIGS. 8 and 9 show the torsion bar mechanism 40 for controlling the tension for pivoting the back rest 31, particularly the back rest structural shell 31e. The adjustable mechanism 40 includes a rotatable control means or wheel 41 at a side of the chair 30 which rotates a worm gear 42a on shaft 42 which in turn rotates a toothed gear 43a attached to a shaft 43. Thus the shaft 43 is moved horizontally on a line between the front and rear of the chair 30. A wedge 44 engages a tapered portion 45a of a torsion bar 45. A lever 46 is secured to the bar 45 and a rod 47 is pivotably secured at the distal end of the lever 46. The opposite end of the rod 47 is secured to a lower end of the back rest structural shell 31e adjacent the pivot 32. The mechanism 40 allows the user to adjust the tension necessary to move the back rest 31 of the chair 30. A button 48 (FIGS. 7 and 10) is used to adjust the height of the chair 30 by means of the gas spring 36a.

Figure 6:
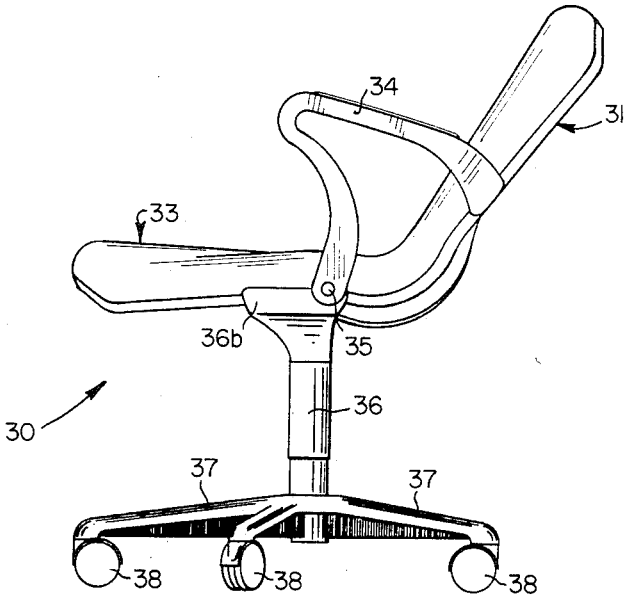
FIG. 6 is a side view of the chair 30 shown in FIG. 3 wherein the back rest 31 is pushed back in the position of a seated person leaning back.

The details of the construction of the structural shells 31e and 33a are shown in FIGS. 14 to 18. FIGS. 14 and 18 show ribs 50 in various portions of the back rest structural shell 31e which allow segments A to E of the chair to flex variably under the weight of the person. Section A (dotted lines) is relatively flexible so that the shoulder portions $P_1$ and $P_2$ of the person P can bend the back rest 31 when tilted in use as shown in FIG. 6. Section B is less flexible and center Section C is relatively rigid. In the seat rear portion 31b, segment C is concave.

FIG. 16 shows the seat forward portion 33 with ribs 51. Segment E is relatively flexible. Segments F and G are relatively rigid. Segment E is flexible so as to allow the legs $P_5$ and $P_6$ to increase the convexity of the lateral segments E. This provides for maximum comfort for the person P in use of the chair.

The back rest structural shell 31e is provided with snap holes 53 for securing the upholstery shell 31d and cushion 31c. The seat forward portion 33c is provided with snap holes 54 for securing the upholstery shell 33b and cushion 33a. A groove 55 is provided for torsion bar 45.

FIGS. 11 and 12 show other chairs 60 and 70. The chair 60 does not include any arms but is otherwise identical to the chair 30. The chair 70 includes a tubular sled base 75. A convex back rest 71 and seat 73 with a pivot 72 between them is provided.

The chair of the present invention provides a unique and more comfortable type of seating for persons who use a chair all day long. The seating is in a more natural position.

The structural shells 31e and 33c are preferably constructed using an outer structural one-piece injection molded material. The inner upholstery shells 31d and 33b shell are preferably made of injection molded polypropylene (or similar material). The shells 31e and 31d and shells 33b and 33c connect to form an assembly with the unique contour and areas of flexibility and rigidity which:

1. reduce and evenly distribute seat pressures over the buttocks and thighs.
2. reduce disc pressure, particularly at the 4th and 5th vertebrae.
3. increase spinal support.
4. improve lung function studies.
5. promote external rotation of the hip joint.
6. provide pelvic stabilization.
7. provide an anchorage and housing for a torsion bar spring mechanism which is adjustable to provide variable back support tension, using an adjustment worm gear mechanism positioned at the right outside edge of the seat.
8. facilitates improved weight drain through improved force transfer vectors created by the chair.

It is intended that the foregoing description be only illustrative and that the present invention be limited only by the hereinafter appended claims.

We claim:

1. In a chair including a seat means for supporting the buttocks and upper legs of a seated person and a backrest means adjacent to the seat means for supporting the back of the person and a support means for the seat means the improvement which comprises:

(a) a seat means wherein an upwardly facing surface supporting the upper legs of the person adjacent a front portion of the seat means is convex in vertical cross section of opposite sides of a vertical midline of the chair and between the sides such that the hip joints in the buttocks of the person externally rotate downward causing the knees to tend to spread apart and the feet of the person to point outwardly; and (b) a backrest means extending from a union means between the seat means and the backrest means supporting the back of the person with a forwardly facing surface near the shoulders and adjacent an upper portion of the backrest means which is convex in horizontal cross-section on opposite sides of the vertical midline of the chair and between the sides.

2. In a chair including a seat means for supporting the buttocks and upper legs of a seated person and a backrest means adjacent to the seat means for supporting the back of the person and a support means for the seat means the improvement which comprises:

(a) a seat means wherein an upwardly facing surface supporting the upper legs of the person adjacent a front portion of the seat means is convex in vertical cross section on opposite sides of a vertical midline of the chair and between the sides such that the hip joints in the buttocks of the person externally rotate downward causing the knees to tend to spread apart and the feet of the person to point outwardly; and (b) a backrest means extending from a union means between the seat means and the backrest means supporting the back of the person with a forwardly facing surface near the shoulders and adjacent an upper portion of the backrest means which is convex in horizontal cross-section on opposite sides of the vertical midline of the chair and wherein the union means has a curved surface which is concave in cross-section on opposite sides of the vertical midline of the chair and between the sides supporting the buttocks.

3. The chair of claim 2 wherein the seat means has a pivot means adjacent to a rear portion of an area of the seat means supporting the upper legs of the person and adjacent to the buttocks on a horizontal axis perpendicular to the vertical midline of the chair and wherein the union means is pivoted on the pivot means so that the backrest means and the union means pivot together away from the seat means as the back of the person exerts pressure on the backrest means and then returns when the pressure is released.

4. The chair of claim 2 wherein the support means comprises legs directly attached to the seat means.

5. The chair of claim 2 wherein the support means is a pedestal with a yoke means attached to the seat means at opposed marginal edges on opposite sides of the vertical midline at one end and having legs extending from the pedestal at an opposite end from the one end.

6. The chair of claim 3 wherein arm rests having an irregular curved shape are secured to the back rest means at one end on either side of the vertical midline and are pivoted on the axis of the pivot means at an opposite end on the seat means on either side of the vertical midline such that the arm rests pivot with the back rest means.

7. The chair of claim 2 wherein the support means is a pedestal with a yoke means attached to the seat means at opposed marginal edges on opposite sides of the vertical midline at one end and having legs extending from the pedestal at the opposite end from the one end, wherein the union means is pivoted on the seat means on a first horizontal axis defined by a pivot means adjacent to a rear portion of an area of the seat means covered by the upper legs of the person and adjacent to the buttocks, wherein the axis is perpendicular to the vertical midline of the chair, wherein a torsion bar is mounted inside the seat means on a second axis parallel to the first axis of the pivot means in a more forward portion of the area of the seat means supporting the upper legs from the rear portion of the area, wherein a wedge means inside the seat means moved by a control means outside the seat means engages a tapered portion of an end of the torsion bar perpendicular to the second axis, and wherein at a spaced apart portion on the torsion bar from the tapered portion a lever is mounted perpendicular to the second axis and wherein a distal end of a rod is pivotally mounted on the union means and a proximal end of the rod is pivotally mounted on the lever so that a force applied to the backrest means by the seated person for pivoting the backrest means and union means on the pivot means twists the torsion bar through the rod and lever and so that the force created by the torsion bar is increased or decreased by the wedge means to increase or decrease a force on the back means necessary for pivoting the back means on the pivot means.

8. The chair of claim 7 wherein the control means is a wheel mounted outside the seat means which rotates a worm gear on a front shaft to in turn rotate a toothed gear on a second shaft which moves the wedge means into and out of engagement of the tapered portion on the end perpendicular to the axis of the torsion bar.

9. The chair of claim 7 wherein the pivot means comprises pins mounted on the yoke means and at opposite marginal edges of the seat means and union means on the first axis.

10. The chair of claim 9 wherein arm rests having an irregular curved shape secured are mounted on the backrest means at one end on opposite sides of the vertical midline and are pivoted on the first axis of the pivot means on the pins such that the arm rest pivots with the backrest means and union means.

11. The chair of claim 3 wherein the support means comprises a pedestal with a yoke means attached to the seat means at opposed marginal edges on opposite sides of the vertical midline.

12. The chair of claim 2 wherein adjacent lateral forward sections of the seat means which are part of the front portion are flexible so that the weight of the upper legs of the person bends the lateral forward sections to provide increased convexity of the seat means and wherein a front central section between the lateral forward sections is relatively more rigid.

13. The chair of claim 2 wherein a rear portion of an area of the seat means supporting the upper legs, the union covered by the buttocks and a lower portion of the backrest means in the lumbar region of the person are rigid, wherein lateral upper sections of the backrest means which are part of the upper portion are relatively less rigid than the rear portion, union means or lower portion of the backrest means such that the shoulders can bend the upper lateral sections to provide increased convexity as increasing pressure from rotation of the upper torso is applied.

14. The chair of claim 2 wherein forward lateral sections of the seat means which are part of the front portion are flexible so that the weight of the upper legs of the person bends the forward lateral sections to provide increased convexity of the seat means and wherein a front central section between the forward lateral sections is relatively more rigid and wherein a rear section of an area of the seat means covered by the upper legs, the union means and a lower section of the backrest means in the lumbar region of the person are relatively rigid, wherein lateral upper sections of the backrest means which are part of the upper portion are relatively less rigid than the rear section, union means or lower portion of the backrest means such that the shoulders can bend the upper lateral sections to provide increased convexity as increasing pressure from rotation of the upper torso is applied.

15. The chair of claim 14 wherein arm rests having an irregular curved shape are mounted to the back rest means at one end on either side of the vertical midline and are pivoted on the first axis of the pivot means at an opposite end on the seat means on either side of the vertical midline such that the arm rest pivots with the back rest means.

16. The chair of claim 14 wherein the union means is pivoted on a first axis defined by a pivot means within and adjacent to a rear portion of an area of the seat means supporting the upper legs of the person and adjacent to the buttocks perpendicular to the vertical midline of the chair, wherein a torsion bar is mounted inside the seat means on a second axis parallel to the first axis of the pivot means in a more forward portion of the area covered by the upper legs, on an opposite side of the pivot means from the rear portion of the area of the seat means supporting the upper legs, wherein a wedge means inside the seat means moved by a control means outside the seat means engages a tapered portion of an end of the torsion bar perpendicular to the second axis, and wherein at a spaced apart portion on the torsion bar from the tapered portion a lever is mounted perpendicular to the second axis and wherein a distal end of a rod is pivotally mounted on the union means and a proximal end of the rod is pivotally mounted on the lever so that a force applied to the backrest means by the seated person for pivoting the backrest means and union means on the pivot means twists the torsion bar through the rod and lever and so that the force created by the torsion bar is increased or decreased by the wedge means to increase or decrease a force on the back means necessary for pivoting the back means on the pivot means.

17. The chair of claim 16 wherein the control means is a wheel mounted outside the seat means which rotates a worm gear mounted on a first shaft to in turn rotate a toothed gear mounted on a second shaft which moves the wedge means into and out of engagement of the tapered portion on the end perpendicular to the axis of the torsion bar.

18. The chair of claim 17 wherein the pivot means comprises pins mounted on the support means adjacent to opposite marginal edges of the seat means and the union means on the first axis.

19. The chair of claim 18 wherein the support means comprises a pedestal with a yoke at one end which supports the seat means and the pins and with legs at an opposite end.

20. The chair of claim 14 wherein the flexing of the lateral upper sections which are part of the upper portion of the backrest means and forward lateral sections of the seat means which are part of the front portion is provided by ribs integrally molded on sheets of material comprising the seat means and the backrest means.

* * * * *

UNITED STATES PATENT AND TRADEMARK OFFICE

CERTIFICATE OF CORRECTION

PATENT NO. : 4,783,121

DATED : November 8, 1988

INVENTOR(S) : Harley E. Luyk

It is certified that error appears in the above—identified patent and that said Letters Patent is hereby corrected as shown below:

Face page, references from page 2 of prior art statement should be added as follows:

--Anatomy for Surgeons, Vol. 3, Hoeber-Harper, pp. 641-692 (1958);
Andersson et al., Scand. J. Rehab. Med. 6:104-114 (1974);
Andersson et al., Scand. J. Rehab. Med. 6:115-121 (1974)--.

Column 3, line 52 "In The Drawing" should be --In The Drawings--.

Column 3, line 57, after "externally" insert --rotated--.

UNITED STATES PATENT AND TRADEMARK OFFICE

CERTIFICATE OF CORRECTION

PATENT NO. : 4,783,121

DATED : November 8, 1988

INVENTOR(S) : Harley E. Luyk

It is certified that error appears in the above—identified patent and that said Letters Patent is hereby corrected as shown below:

Column 4, line 11, before "bar" insert --torsion--.

Column 4, line 13, "sho" should be --showing--.

Column 9, line 7, "of" (1st occurrence) should be --on--.

Signed and Sealed this

Second Day of May, 1989

*Attest:*

DONALD J. QUIGG

*Attesting Officer*

*Commissioner of Patents and Trademarks*